US008635716B2

(12) United States Patent
Shon

(10) Patent No.: US 8,635,716 B2
(45) Date of Patent: Jan. 28, 2014

(54) URINAL FOR BOYS

(76) Inventor: Taegug Shon, Gwangmyeong-si (KR)

( * ) Notice: Subject to any disclaimer, the term of this patent is extended or adjusted under 35 U.S.C. 154(b) by 0 days.

(21) Appl. No.: 13/977,834

(22) PCT Filed: Dec. 16, 2011

(86) PCT No.: PCT/KR2011/009723

§ 371 (c)(1),
(2), (4) Date: Jul. 1, 2013

(87) PCT Pub. No.: WO2012/091334

PCT Pub. Date: Jul. 5, 2012

(65) Prior Publication Data

US 2013/0276219 A1 Oct. 24, 2013

(30) Foreign Application Priority Data

Dec. 30, 2010 (KR) ..... 10-2010-0139304

(51) Int. Cl.
*A47K 11/00* (2006.01)

(52) U.S. Cl.
USPC ..... 4/144.1

(58) Field of Classification Search
USPC ..... 4/144.1
See application file for complete search history.

(56) References Cited

U.S. PATENT DOCUMENTS 4,044,405 A * 8/1977 Kreiss ..... 434/247
D276,361 S * 11/1984 Hyman, Sr. ..... D23/297
4,612,676 A * 9/1986 Whitman ..... 4/300.3
D316,748 S * 5/1991 Penn ..... D23/302
D318,325 S * 7/1991 McKiney ..... D23/302
5,040,248 A * 8/1991 Kelly ..... 4/462
5,044,020 A * 9/1991 Lewandowski et al. ..... 4/301
5,388,279 A * 2/1995 Rasmussen ..... 4/144.1
5,509,149 A * 4/1996 Lynch ..... 4/476
5,681,199 A * 10/1997 Morris ..... 446/73
6,000,943 A * 12/1999 Dawson ..... 434/247
7,996,926 B2 * 8/2011 Aguila ..... 4/144.1
2002/0020006 A1 * 2/2002 Mason et al. ..... 4/144.1
2008/0052810 A1 * 3/2008 Zeeb et al. ..... 4/144.1
2010/0077540 A1 * 4/2010 Aguila ..... 4/144.2

FOREIGN PATENT DOCUMENTS

JP 2004-344393 A 12/2004
KR 20-0378346 Y1 3/2005
KR 10-2009-0025457 A 3/2009

OTHER PUBLICATIONS

International Search Report for PCT/KR2011/009723 mailed Jul. 30, 2012 from Korean Intellectual Property Office.

* cited by examiner

*Primary Examiner* — Lori Baker
(74) *Attorney, Agent, or Firm* — Sherr & Jiang, PLLC

(57) ABSTRACT

A urinal for boys, the urinal including: a urinal main body having a urine receptacle at a front surface; a body having one side on which the urinal main body is mounted, and including a plurality of stopper portions spaced apart from each other in a vertical direction at the other side; and a lifting unit including a lifting portion having coupling grooves at a top for lateral side coupling in accordance with the plurality of stopper portions, and a support portion connected to the lifting portion and having a bottom surface formed such that the lifting unit stands on the ground.

6 Claims, 5 Drawing Sheets

URINAL FOR BOYS

CROSS REFERENCE TO PRIOR APPLICATION

This application is a National Stage Patent Application of PCT International Patent Application No. PCT/KR2011/009723 (filed on Dec. 16, 2011) under 35 U.S.C. §371, which claims priority to Korean Patent Application No. 10-2010-0139304 (filed on Dec. 30, 2010), which are all hereby incorporated by reference in their entirety.

TECHNICAL FIELD

The present invention relates to a urinal for boys, and more particularly, to a urinal for boys, which provides convenience to the boy by forming the urinal provided and used indoors in an upright type, and at the same time, has a height adjustable according to growth of the boy.

BACKGROUND ART

Generally, a family with a child uses a toy urinal having any character shape. Such a urinal is manufactured such that the child urinates while being seated regardless of a gender of the child, and is manufactured mainly considering a design favored by children rather than considering functionalities. However, since the child urinates while being is seated regardless of the gender, the child may be unable to urinate single-handedly due to low adaptability to the urinal. Also, since urination angles and locations are different according to children based on their body dimensions, some urine may be leaked outside the urinal and contaminate an indoor space.

Accordingly, a urinal for boys, which has a space to accommodate urine therein and has a vacuum suction plate at a rear surface to be adhered to a bathroom wall formed of tiles or glass, has been suggested. However, it is difficult for a child using the urinal adhered to the bathroom wall to step over a bathroom threshold or hold the urine until reaching the bathroom. Also, the child may slip on a bathroom floor due to moisture and get hurt. Thus, parents wish to install the urinal in a living room, but it is difficult to adhere and fix the vacuum suction plate of the urinal to a wall of the living room.

DETAILED DESCRIPTION OF THE INVENTION

Technical Problem

The present invention provides a urinal for boys, which provides convenience to the boy by forming the urinal in an upright type, is providable any indoors, and has a height adjustable according to growth of the boy.

Technical Solution

According to an aspect of the present invention, there is provided a urinal for boys, the urinal including: a urinal main body having a urine receptacle at a front surface; a body having one side on which the urinal main body is mounted, and including a plurality of stopper portions spaced apart from each other in a vertical direction at the other side; and a lifting unit including a lifting portion having coupling grooves at a top for lateral side coupling in accordance with the plurality of stopper portions, and a support portion connected to the lifting portion and having a bottom surface formed such that the lifting unit stands on the ground.

The urinal main body may have an inner center portion that inclines towards right and left and protrudes forward.

The urinal main body may be detachably combined to the body and include a handle portion for a user to hold.

The body may further include a vacuum suction plate at a rear surface to be is attached to or detached from a wall.

The body may have a character shape.

The lifting unit may include a space portion that has a center of gravity by accommodating water therein to stand on the ground.

Advantageous Effects

A urinal according to one or more embodiments of the present invention has following effects.

First, convenience may be provided to a boy by forming the urinal that has been used by a child while being seated regardless of a gender of the child, in an upright type.

Second, by adjusting a height of the urinal according to growth or body dimensions of the boy, urine may be prevented from leaking outside the urinal.

Third, urine does not splash but flows downward by a protruding portion formed inside a urinal main body.

Fourth, the urinal main body is detachably combined to a body, and may be easily emptied and washed during detachment by using a handle portion formed inside the urinal main body so as to maintain a clean state.

Fifth, the urinal main body may have any character shape to provide friendliness to the boy, and advance the boy to have self-reliance on urinating during potty training.

Figure 1:
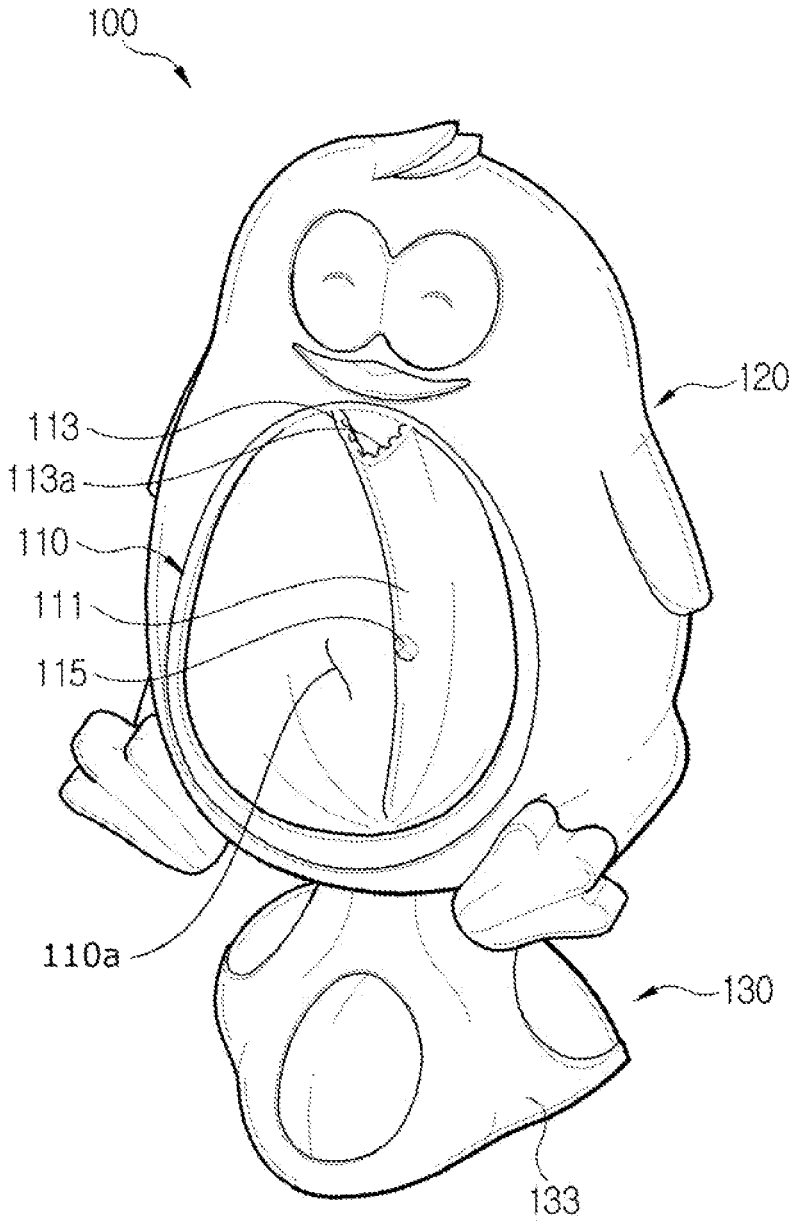
FIG. 1 is a perspective view of a urinal for boys, according to an embodiment of the present invention.

100: Urinal for Boys
110: Urinal Main Body
111: Protruding Portion
113: Handle Portion
120: Body
121: Stopper Portion
123: Fixing Portion
130: Lifting Unit
131: Lifting Portion
133: Support Portion
10: Wall
20: Floor

MODE OF THE INVENTION

Hereinafter, the present invention will be described more fully with reference to the accompanying drawings, in which exemplary embodiments of the invention are shown. In the drawings, like reference numerals denote like elements.

Figure 2:
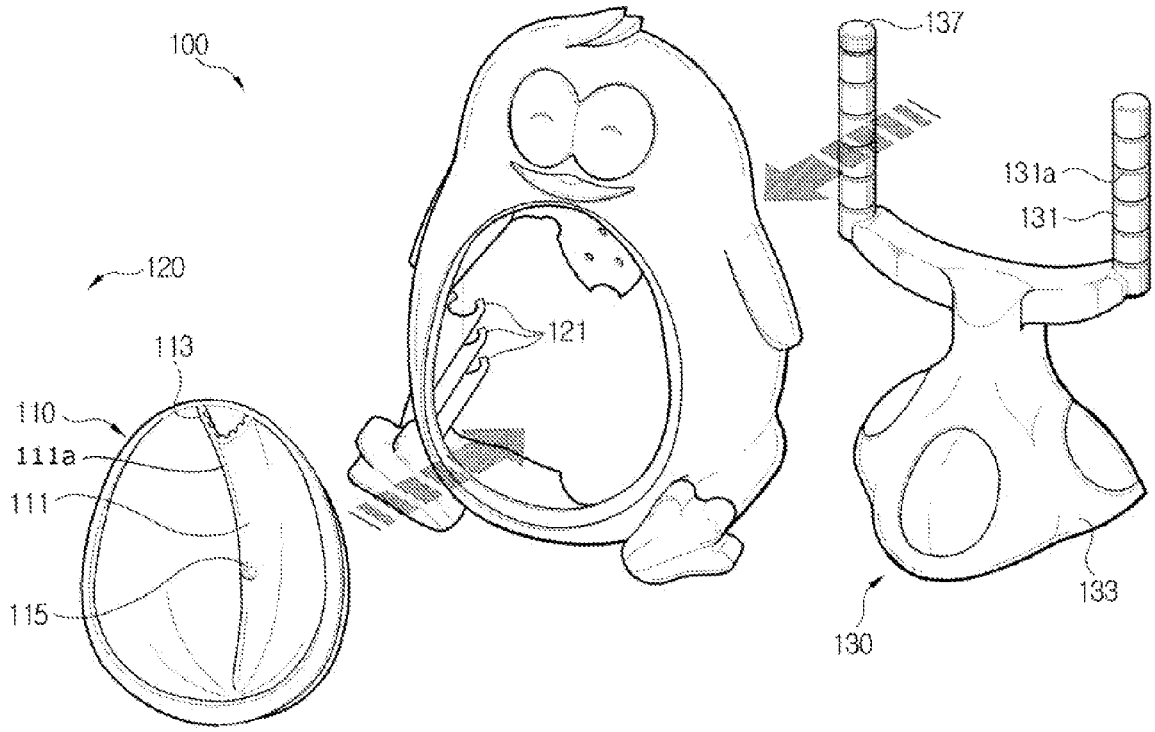
FIG. 2 is an exploded perspective view of the urinal of FIG. 1.

FIG. 1 is a perspective view of a urinal 100 for boys, according to an embodiment of the present invention, and FIG. 2 is an exploded perspective view of the urinal 100 of FIG. 1.

Figure 3:
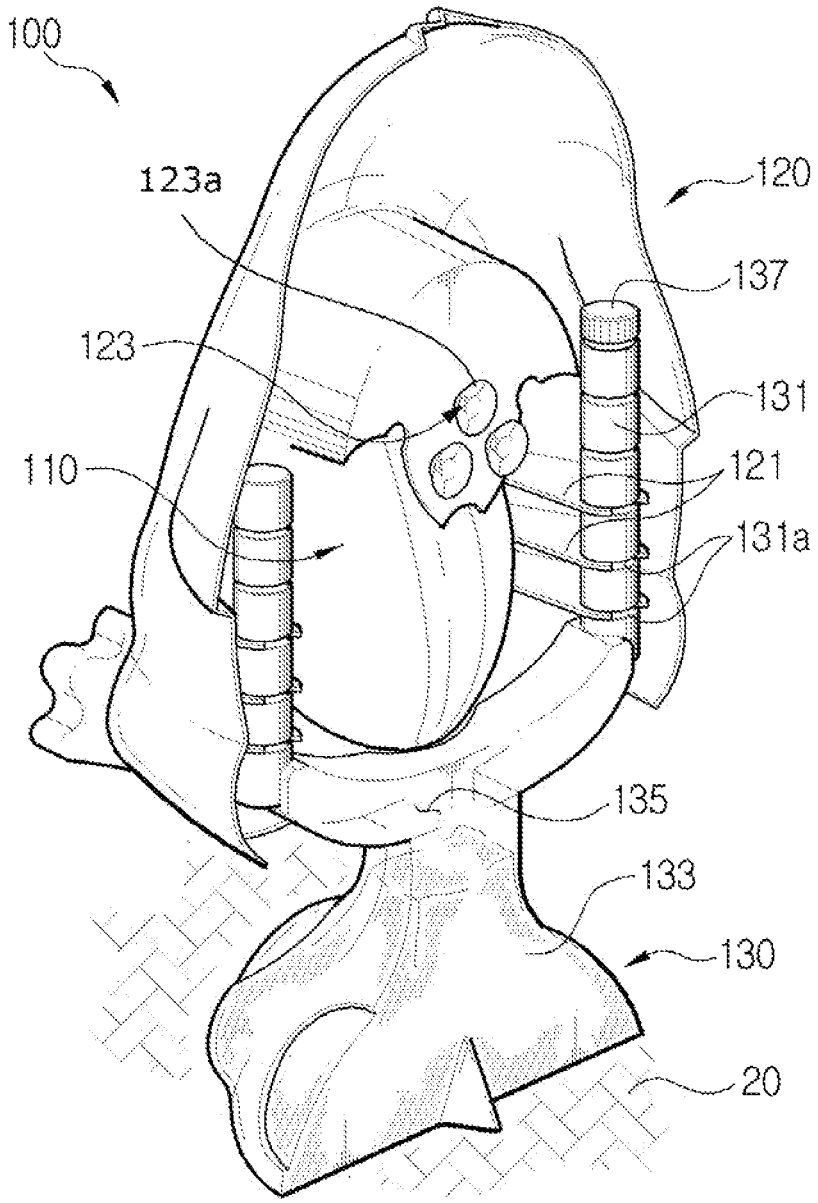
FIG. 3 is a rear view of the urinal of FIG. 1 in a used state.
Figure 4:
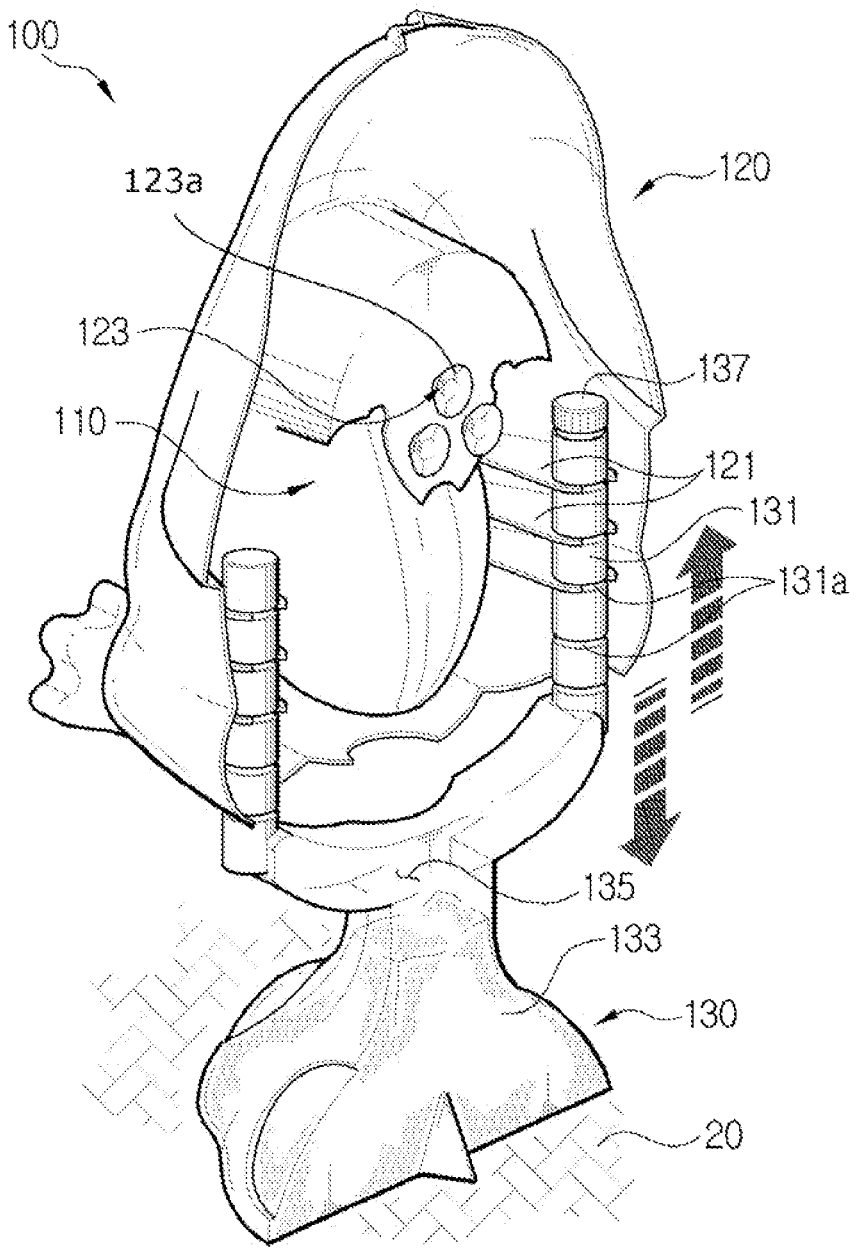
FIG. 4 is a view of the urinal of FIG. 3, wherein a urinal main body combined to a lifting unit is elevated.

FIG. 3 is a rear view of the urinal 100 of FIG. 1 in a used state and FIG. 4 is a view of the urinal 100 of FIG. 3, wherein a urinal main body 110 combined to a lifting unit 130 is elevated.

Figure 5:
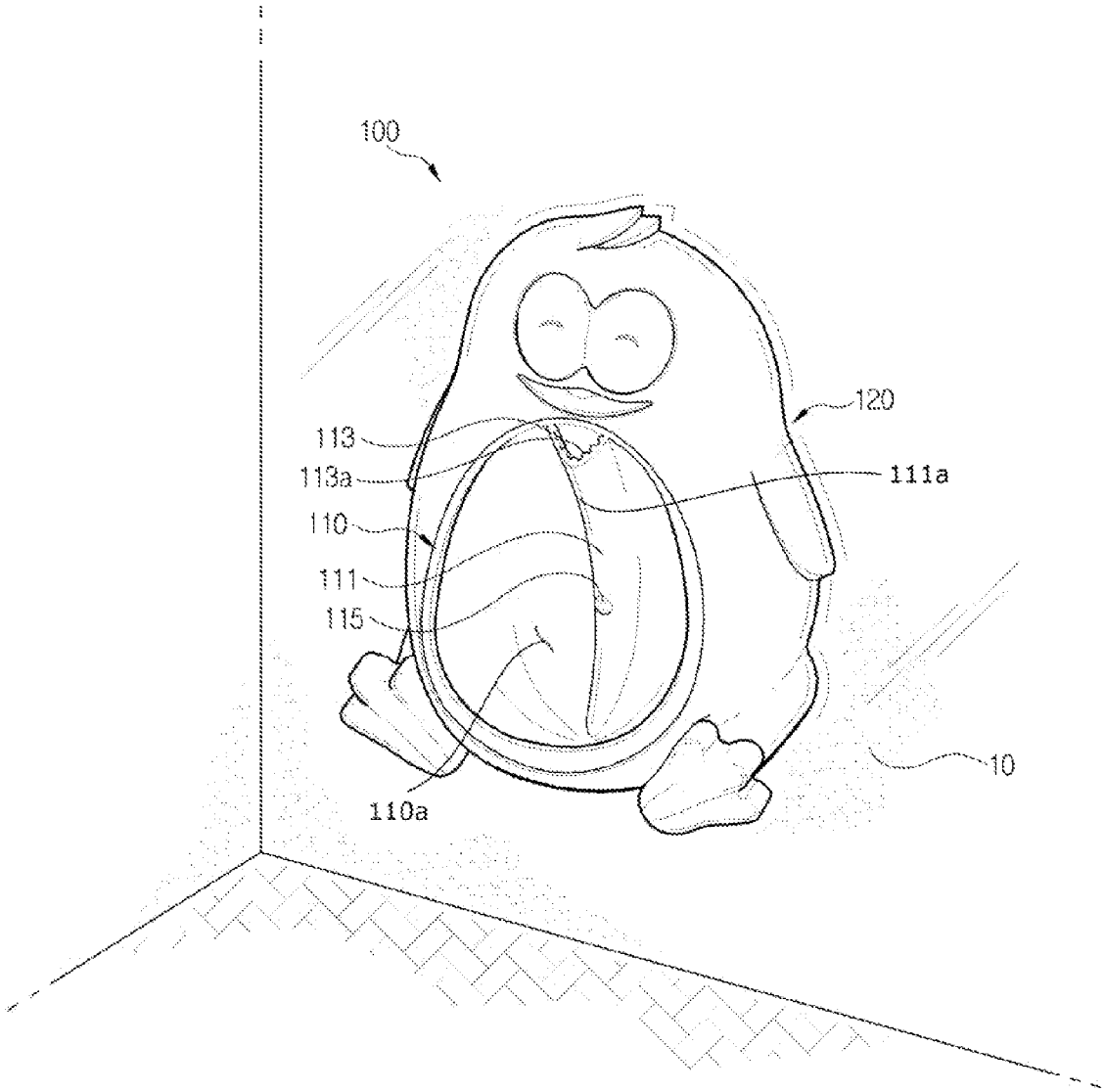
FIG. 5 is a view of the urinal of FIG. 1 adhered to a wall, according to an embodiment of the present invention.

FIG. 5 is a view of the urinal 100 of FIG. 1 adhered to a wall 10, according to an embodiment of the present invention.

Referring to FIGS. 1 through 5, the urinal 100 includes the urinal main body 110, a body 120, and the lifting unit 130. Here, the urinal 100 is formed in an upright type to provide convenience to a boy who is urinating, thereby increasing adaptability of the boy to a urinal.

The urinal main body 110 includes a protruding portion 111 and a handle portion 113. Here, the urinal main body 110 has a urine receptacle 110*a* (i.e. an inner space) at a front surface thereof to accommodate urine of the boy and is accommodated at one side of the body 120.

The protruding portion 111 is formed inside the urinal main body 110 and has an inner center portion 111*a* inclining towards right and left and protruding frontward. Such a protruding portion 111 prevents urine from splashing due to rebound and enables urine to slantly flow right and left. Here, the protruding portion 111 has a smooth curve shape, but a shape of the protruding portion 111 is not limited as long as its purpose is achieved. Also, a urine aiming portion is attached to the inner center portion 111*a* of the urinal main body 110. The urine aiming portion 115 prevents urine from leaking by inducing the boy to accurately aim the urine.

The handle portion 113 is formed such that the urinal main body 110 is held at an is inner top end. The handle portion 113 enables a user to easily hold and move the urinal main body 110 when urine is filled in the urinal main body 110 or when washing the urinal main body 110. Here, as shown in FIGS. 1 and 2, the handle portion 113 may be formed as a top end of the protruding portion 111 is opened, and the user may hold an inner side and an outer side of the opened portion using fingers. Meanwhile, uneven portion 113*a* may be formed on an inside of the handle portion 113. The uneven portion 113*a* prevents the fingers from slipping while holding the handle portion 113. Accordingly, the urinal main body 110 may not slip while being attached to or detached from the body 120, and may be stably moved.

The body 120 includes a stopper portion 121 and a fixing portion 123. The body 120 detachably accommodates the urinal main body 110, and is combined to the lifting unit 130 at the other side. The stopper portion 121 is formed on the other side of the body 120, and is combined to a coupling groove 131*a* of the lifting unit 130 that is described below. Here, a plurality of the stopper portions 121 are formed spaced apart from each other in a vertical direction, and the coupling grooves 131*a* have corresponding shapes. Also, the stopper portions 121 are formed at each side of the body 120.

The fixing portion 123 is combined to a rear surface extending from a top of the body 120, and is configured to be fixed to the wall 10. Here, the fixing portion 123 may be a vacuum suction plate 123*a* to be easily fixed to the wall 10. The urinal 100 has the upright type and generally stands on the ground 20, but alternatively, may be attached to the wall 10.

The lifting unit 130 includes a lifting portion 131 and a support portion 133. The lifting portion 131 has a circular bar shape and has the coupling groove 131*a* to be combined in accordance with the stopper portion 121. Here, a plurality of the coupling grooves 131*a* may be formed along a vertical direction of the lifting portion 131. Also, the coupling groove 131*a* is formed on an outer circumferential surface along a circumference of the lifting portion 131, and is formed smaller than an outer circumferential surface of the lifting portion 131 such that the stopper portion 121 is fixed without moving up and down during lateral side coupling. Meanwhile, a pair of the lifting portion 131 is formed to correspond to the stopper portion 121 at the right and left of the body 120, and is integrally connected to the support portion 133.

The support portion 133 is connected to the lifting portion 131 and fixes the body 120 to stand upright to the ground 20. Also, the lifting unit 130 has a space 135 therein. Here, water is supplied into the space 135 through an injection portion 137 formed at one top surface of the lifting portion 131, and the lifting unit 130 stands on the ground 20 with a center of gravity by the weight of water.

Operations and effects of the urinal 100 according to an embodiment of the present invention will now be described with reference to accompanying drawings.

First, the user may pour water into the injection portion 137 formed at the lifting unit 130 such that the lifting unit 130 stands on the ground 20 with the center of gravity. Then, the body 120 is combined to the lifting unit 130. Here, the stopper portion 121 formed on the body 120 is laterally combined to the coupling groove 131*a* of the lifting portion 131. At this time, a height of the body 120 may be adjusted according to body dimensions of the boy using the urinal 100. Then, the urinal main body 110 is accommodated in one side of the body 120. Meanwhile, when the boy using the urinal 100 gets used to urinating, the fixing portion 123 formed at the rear surface of the body 120 is attached to the wall 10 at one side of a toilet in a bathroom.

As described above, convenience may be provided to the boy by forming the urinal 100 that has been used by a child while being seated regardless of a gender of the child, in the upright type. Also, by adjusting the height of the urinal 100 according to the growth or body dimensions of the boy, urine may be prevented from leaking outside the urinal 100. Also, urine does not splash but flows downward by the protruding portion 111 formed inside the urinal main body 110. In addition, the urinal main body 110 is detachably combined to the body 120, and may be easily emptied and washed during detachment by using the handle portion 113 formed inside the urinal main body 110 so as to maintain a clean state. Also, since the urinal 100 may be fixed to the wall 10 of the bathroom by using the fixing portion 123 formed at the rear surface of the urinal 100, adaptability of the boy to the bathroom may be increased. Lastly, the urinal main body 110 may have any character shape to provide friendliness to the boy, and advance the boy to have self-reliance on urinating during potty training.

While the present invention has been particularly shown and described with reference to exemplary embodiments thereof, it will be understood by those of ordinary skill in the art that various changes in form and details may be made therein without departing from the spirit and scope of the present invention as defined by the following claims.

The invention claimed is:

1. A urinal for boys, the urinal comprising:

a urinal main body having a urine receptacle at a front surface;

a body having one side on which the urinal main body is mounted, and comprising a plurality of stopper portions spaced apart from each other in a vertical direction at the other side; and a lifting unit comprising a lifting portion having coupling grooves at a top for lateral side coupling in accordance with the plurality of stopper portions, and a support portion connected to the lifting portion and having a bottom surface formed such that the lifting unit stands on the ground.

2. The urinal of claim 1, wherein the urinal main body has an inner center is portion that inclines towards right and left and protrudes forward.

3. The urinal of claim 1, wherein the urinal main body is detachably combined to the body and comprises a handle portion for a user to hold.

4. The urinal of claim 1, wherein the body further comprises a vacuum suction plate at a rear surface to be attached to or detached from a wall.

5. The urinal of claim 1, wherein the body has a character shape.

6. The urinal of claim 1, wherein the lifting unit comprises a space portion that has a center of gravity by accommodating water therein to stand on the ground.

* * * * *